US010532380B2

(12) United States Patent
Martori

(10) Patent No.: US 10,532,380 B2
(45) Date of Patent: Jan. 14, 2020

(54) MAKING AN ORE SEPARATION WHEEL

(71) Applicant: Joseph J. Martori, Fort Mohave, AZ (US)

(72) Inventor: Joseph J. Martori, Fort Mohave, AZ (US)

( * ) Notice: Subject to any disclaimer, the term of this patent is extended or adjusted under 35 U.S.C. 154(b) by 94 days.

(21) Appl. No.: 15/700,128

(22) Filed: Sep. 9, 2017

(65) Prior Publication Data

US 2018/0071781 A1 Mar. 15, 2018

Related U.S. Application Data

(60) Provisional application No. 62/385,855, filed on Sep. 9, 2016.

(51) Int. Cl.

| | |
|---|---|
| ***B07B 1/08*** | (2006.01) |
| ***B07B 1/46*** | (2006.01) |
| ***B03B 5/74*** | (2006.01) |
| *B03B 5/02* | (2006.01) |

(52) U.S. Cl.

CPC ..... *B07B 1/08* (2013.01); *B03B 5/74* (2013.01); *B07B 1/4654* (2013.01); *B03B 5/02* (2013.01)

(58) Field of Classification Search

CPC B07B 1/08; B07B 1/4654; B03B 5/02; B03B 5/68; B03B 5/74; B29C 48/00; B29C 48/001; B29C 64/00

See application file for complete search history.

(56) References Cited

U.S. PATENT DOCUMENTS

| | | | | |
|---|---|---|---|---|
| 1,081,421 A | | 12/1913 | Arnold | |
| 4,267,036 A | | 5/1981 | Kleven | |
| 4,389,308 A | | 6/1983 | Cleland | |
| 4,406,783 A | | 9/1983 | Cleland | |
| 4,476,014 A | * | 10/1984 | Cleland | B03B 5/02 156/160 |
| 4,517,079 A | | 5/1985 | Cleland | |

(Continued)

*Primary Examiner* — Joseph C Rodriguez
*Assistant Examiner* — Kalyanavenkateshware Kumar
(74) *Attorney, Agent, or Firm* — Michael W. Starkweather

(57) ABSTRACT

A method of making a circular ore separation wheel, for concentration critical stategic rare earths, and preciouse metals, such as gold. The method comprising: 1) forming a base section of the circular ore separation wheel using 3D printing; 2) forming a central hole in the base section being centrally located in the circular ore separation wheel; 3) forming a plurality of teeth, using 3D printing, upon the base section, having a inner end proximate to the central hole and extending therefrom in a circularly radiating direction and having an outer end opposite the inner end with different sizes on the same length of tooth, 4) forming a plurality of micro grooves from about 4.5-0.001 mm partially along outer surfaces of the plurality of teeth extending in a direction from the inner end to the outer end of the plurality of teeth, wherein the plurality of micro grooves are formed by the 3D printing process leaving a small gap located between subsequent extruded layers at the outer surface of the plurality of teeth; and 5) forming a circumferential wall around the ore separation wheel that is proximate to the outer end of the plurality of teeth, and is proximate to the base section. And potentially manufacturing the circular ore separation wheel inside of a pre-made support section with the desired internal concave contours.

18 Claims, 4 Drawing Sheets

(56) References Cited

U.S. PATENT DOCUMENTS

| | | | | |
|---|---|---|---|---|
| 4,522,711 | A | 6/1985 | Cleland | |
| 5,788,293 | A * | 8/1998 | Krenzler | B03B 5/74 209/434 |
| 5,868,366 | A * | 2/1999 | Tubbs, Jr. | B03B 5/74 209/434 |
| 5,943,235 | A | 8/1999 | Earl et al. | |
| 5,957,303 | A * | 9/1999 | Krenzler | B03B 5/02 209/434 |
| 6,749,414 | B1 | 6/2004 | Hanson et al. | |
| 9,339,974 | B2 | 5/2016 | Spalt | |
| 9,533,449 | B2 | 1/2017 | Page | |
| 9,656,423 | B2 | 5/2017 | Hartmann | |
| 9,669,586 | B2 | 6/2017 | Page | |
| 2014/0311651 | A1 | 10/2014 | Mech | |
| 2015/0165675 | A1 | 6/2015 | Dawson et al. | |

* cited by examiner

MAKING AN ORE SEPARATION WHEEL

CROSS REFERENCE TO RELATED APPLICATIONS

This application claims the benefit of copending U.S. Provisional Application No. 62/385,855, having the same inventor, Joseph J. Martori, filed on Sep. 9, 2016.

BACKGROUND OF THE INVENTION

Field of the Invention

The present invention relates generally to the field of ore separation by specific gravity of 10.0 plus, riffle (teeth and valley) manufacturing; and more particularly to a 3D printing method for making a gold separation pad having teeth, riffles, valleys, and creating at least a portion with a negative draft riffle or teeth angle being less than 90 deg. for capture of gold, critical and stategic rare earths and preciouse metals.

Background of the Invention

The present invention relates generally to the field of ore separation machines, and specifically to a system and method for ore separation riffle pad manufacturing used by gold miners. Referring to U.S. Pat. No. 4,517,079, which is herein incorporated by reference, it teaches of a typical round ore separator or concentrator design. Past production/commercial ore separation systems do not work efficiently, fall apart too soon, and are difficult to make.

Most ore concentrators embodiments for this argument have a round body. The round bodies have either had a flat back like the hybrid rotary tables from the 1950's to date, or have had any shape of degree to the concave that were not correct for the riffles equaling no negative draft. Also, to actually work 100% efficiently, the riffles could not be made of a rigid or square design (90°) or more, which do not have any negative draft. They did not work for a commercial mine production setting with successfully expected results. They did work 10% to 20% for a weekend miner hobbyist on wheels less than 25" in diameter. Here is the difference between no negative draft and negative draft.

The purpose of this present invention is to teach a new method of making such ore separator pads. Specifically, during the last decade, 3D printers have become common tools for producing 3D physical objects from digital data, such as computer-aided design (CAD) models and animation models. As a consequence, the use of rapid prototyping is now becoming more common in many domains. In particular, architects can greatly benefit from 3D printing. They can produce accurate 3D architectural objects within a few hours instead of days or even months. These prototypes enable a. natural mechanism for repeated reevaluation of architectural projects during their progress, and in particular the detection of difficulties at early stages. Nowadays, 3D printing can be optimized for speed, low cost, and ease-of-use, making it suitable for inspection during the conceptual stages of engineering design when accuracy and mechanical strength of prototypes are important.

Many well-known firms, such as the international "Z Corporation®", "Object Technologies®", and "3D Systems®®" companies, and the "Stratasys®" company, located in the United States, manufacture devices that produce 3D physical objects. These various devices are based on several different competing technologies. Evidently, 3D printers produced by different manufacturers, and also different models produced by the same manufacturer, pose different characteristics; they operate differently, and usually, are constrained to different restrictions. However, in one embodiment, many 3D printers, are based on additive manufacturing technology, which transforms the model to be fabricated into relatively thin horizontal cross-sections, and then creates successive layers, etc. until the fabrication is complete. One of the differences between various 3D printers is the way layers are built to create portions of a 3D model to be printed. it should be noted that resolution is usually given in layer thickness, and the XY-resolution is given in dots per inch (DPI). It should be noted that the layer thickness is usually approximately a hundredth of a micrometer (0.1 mm), while XY-resolution is comparable to that of laser printers. The particles (3D dots) are approximately from a fiftieth to a hundredth of a micrometer (0.05 mm-0.1 mm) in diameter.

Conventional 3D printers may also produce correct 3D physical objects only when fed with valid printable models. Such models are represented as polygonal meshes, for example, in the STL (Stereolithography) file-format. A valid model represented as a. polygonal mesh comprises a polygon-soup (an arbitrary set of polygons) that represents a closed 2D-manifold, i.e., a watertight object with substantially no artifacts, such as self-intersections, or a collection of closed 2D-manifolds that substantially do not intersect each other. A valid printable model satisfies additional requirements imposed by various printing devices (different 3D printing devices impose different requirements, as they are based on different technologies).

It should be noted that correct and consistent representations of 3D objects are required by conventional applications, such as modeling, simulation, visualization, CAD (Computer-Aided Design), CAM (Computer-Aided Manufa.cturing), finite element analysis, and the like.

Accordingly, various prior arts have disclosed such related inventions, whereby the provided following patents are herein incorporated by reference for their supportive teachings and enablement criteria for the technology needed to enable one skilled in the art to make and use the subject invention, in which:

U.S. Pat. No 1,081,421, issued Dec. 16, 1913, and discloses an ore concentrating machine.

U.S. Pat. No. 4,267,036, issued May 12, 1981, discloses an apparatus and method for separating free metal from ore.

U.S. Pat. No. 4,389,308, issued Jun. 21, 1983, teaches of an apparatus for separating ores.

U.S. Pat. No. 4,406,783, issued Sep. 27, 1983, teaches of an apparatus for separating ores.

U.S. Pat. No. 4,517,079, issued May 14, 1985, discloses an ore separation system.

U.S. Pat. No. 4,476,014, issued October 1984, discloses a method of making an ore concentrator, and concentrator thus made.

U.S. Pat. No. 94,522,711, issued: Jun. 11, 1985 discloses an ore separation system.

US. Patent app. No.: 2015/0165675, pub. Data: Jun. 18, 2015, discloses a 3D printing.

US. Patent app. No.: 2014/0311651, published: Oct. 23, 2014, discloses a 3D offset printing.

U.S. Pat. No. 5,943,235, issued Aug. 24, 1999, discloses a rapid prototyping system and method with supporting region data processing.

U.S. Pat. No. 6,749,414, issued Jun. 15, 2004, discloses extrusion apparatus for three-dimensional modeling.

U.S. Pat. No. 9,339,974, issued May 17, 2016, discloses application of additive manufacturing processes to efficiently achieve higher levels of hardware integration.

U.S. Pat. No. 9,533449, issued: Jan. 3, 2017, discloses material deposition systems with four or more axes.

U.S. Pat. No. 9,656,423, issued May 23, 2017, discloses a device and method for producing three-dimensional models.

U.S. Pat. No. 9,669,586, issued Jun. 6, 2017, discloses a material dispensing system.

Despite the various teachings of the incorporated references provided above, none of the art taken singly or in combination is believed to teach the following invention. In particular, there is a need for making ore concentrator pads with teeth and valleys (riffles) shaped so that at least a portion form a negative draft or angles being less than 90 degrees. Up to this time, there has not been an easy, fast, accurate, or inexpensive method of making a negative draft ore concentrator pad.

SUMMARY

In view of the foregoing disadvantages inherent in the known types of apparatus like in the prior art, the present invention provides an improved apparatus. As such, the general purpose of the present invention, which will be described subsequently in greater detail, is to provide a new and improved apparatus with all the advantages of the prior art and none of the disadvantages.

Accordingly, it is a feature of the present invention to provide a method of making a circular ore separation wheel with riffles or teeth thereon, comprising: 1) forming a base section of the circular ore separation wheel using 3D printing; 2) forming a central hole in the base section being centrally located in the circular ore separation wheel; 3) forming a plurality of teeth, using 3D printing, upon the base section, having a inner end proximate to the central hole and extending therefrom in a circularly radiating direction and having an outer end opposite the inner end; and 4) forming a circumferential wall around the ore separation wheel that is proximate to the outer end of the plurality of teeth, and is proximate to the base section.

Another feature may be provided wherein the forming plurality of teeth further includes forming each of the plurality of inner ends having at least one dimension being smaller than the outer end of the plurality of teeth.

Another feature may be provided wherein the one dimension is size of teeth.

Another feature may be provided, further comprises forming a support bowl, with a bowl central hole and a side support wall with a up to 20% angle and then forming the base, central hole, plurality of teeth, and circumferential wall within the support bowl.

Another feature may be provided, wherein the circumferential wall is shorter than the side support wall of the support bowl.

Another feature may be provided, wherein the support bowl is formed using a CNC machine, in one embodiment.

Another feature, in one embodiment, is to make the support bowl out of, fiberglass or fiberglass reinforced plastic, or any other support type materials.

Another feature may be provided, wherein the inner end of the plurality of teeth have a major angle having at least a portion of a measure of about 89-10 deg. from a backside of each tooth to a plane extending along a bottom portion of each tooth, wherein the same plurality of teeth will have an outer end of the plurality of teeth have the major angle having at least a portion of a measure of about 1-89 deg. less than the inner end.

Another feature may be provided, wherein the inner end of the plurality of teeth have a major angle having a measure of about 62 deg. from a backside of each tooth to a plane extending along a bottom portion of each tooth, wherein the same plurality of teeth will have an outer end of the plurality of teeth have the major angle with a measure of about 79 deg.

Another feature may be provided, further comprising a valley angle with a measurement of 20-50 deg. measured from the backside of each tooth to a front side of each subsequent tooth.

Another feature may be provided, further comprising a valley angle with a illustrated specific measurement of about 32 deg. measured from the backside of each tooth to a front side of each subsequent tooth.

Another feature may be provided, wherein the inner end of the plurality of teeth have a valley angle having a measure of about 32.65 deg., wherein the same plurality of teeth will have an outer end of the plurality of teeth have the valley angle having a measure of about 15-50 deg. greater than the inner end.

Another feature may be provided, where in the forming a plurality of teeth includes forming a plurality of micro grooves partially along surfaces of the teeth in a direction running from the inner to outer ends.

Another feature may be provided, wherein the plurality of micro grooves are formed by the 3D printing process leaving about a 4.5 to 0.001 mm gap located between subsequent extruded layers at the outer surface of the plurality of teeth.

Another feature is to provide a method of making a circular ore separation wheel, comprising: forming a base section of the circular ore separation wheel using 3D printing; forming a central hole in the base section being centrally located in the circular ore separation wheel; forming a plurality of teeth, using 3D printing, upon the base section, having a inner end proximate to the central hole and extending therefrom in a circularly radiating direction and having an outer end opposite the inner end; forming a plurality of micro grooves along outer surfaces of the plurality of teeth extending in a direction from the inner end to the outer end of the plurality of teeth, wherein the plurality of micro grooves are formed by the 3D printing process leaving a small gap located between subsequent extruded layers at the outer surface of the plurality of teeth; and forming a circumferential wall around the ore separation wheel that is proximate to the outer end of the plurality of teeth, and is proximate to the base section.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

BRIEF DESCRIPTION OF THE DRAWINGS

To further clarify various aspects of some example embodiments of the present invention, a more particular description of the invention will be rendered by reference to specific embodiments thereof that are illustrated in the appended drawing. It is appreciated that the drawing depicts only illustrated embodiments of the invention and are therefore not to be considered limiting of its scope. The invention will be described and explained with additional specificity and detail through the use of the accompanying drawing in which.

DETAILED DESCRIPTION OF THE INVENTION

The embodiments of the present disclosure described below are not intended to be exhaustive or to limit the disclosure to the precise forms disclosed in the following detailed description. Rather, the embodiments are chosen and described so that others skilled in the art may appreciate and understand the principles and practices of the present disclosure.

The following embodiments and the accompanying drawings, which are incorporated into and form part of this disclosure, illustrate embodiments of the invention and together with the description, serve to explain the principles of the invention. Any figures and accompanied descriptions provided in the background art provided above are to also be considered in the understanding of the present invention and potential operation thereof. To the accomplishment of the foregoing and related ends, certain illustrative aspects of the invention are described herein in connection with the following description and the annexed drawings. These aspects are indicative, however, of but a few of the various ways in which the principles of the invention can be employed and the subject invention is intended to include all such aspects and their equivalents. Other advantages and novel features of the invention will become apparent to one skilled in the art from the following detailed description of the invention when considered in conjunction with the drawings and the other incorporated by reference art provided.

This section summarizes some aspects of the present disclosure and briefly introduces some nillustrated embodiments. Simplifications or omissions in this section as well as in the abstract or the title of this description may be made to avoid obscuring the purpose of this section, the abstract and the title. Such simplifications or omissions are not intended to limit the scope of the present disclosure nor imply any limitations.

For the purposes of the following discussions and related to the relative angles provided these are all based on an eight foot in diameter ore separation wheel, and will become apparent to one skilled in the art upon reading herein. Also, the specific water flow over the wheel 10 is highly variable and greatly affects the efficiency of the ore separation. This water rate control is an art and needs to be monitored by the skilled artisan at all times during the operation thereof. Also, the tilt of the wheel and the rate of the wheel rotation all affect the efficience and must be constantly adjusted for each particular operational time periods.

Figure 1:
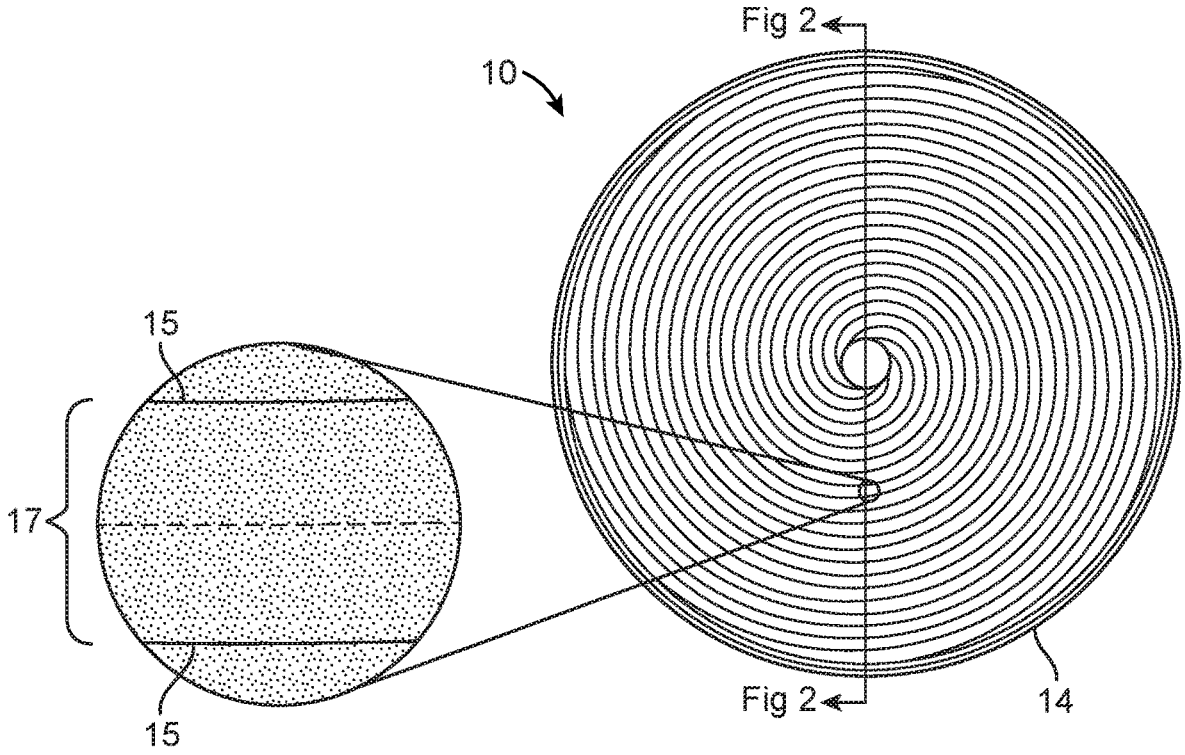
FIG. 1 is front view of the present invention with an exploded view of a portion thereof
Figure 2:
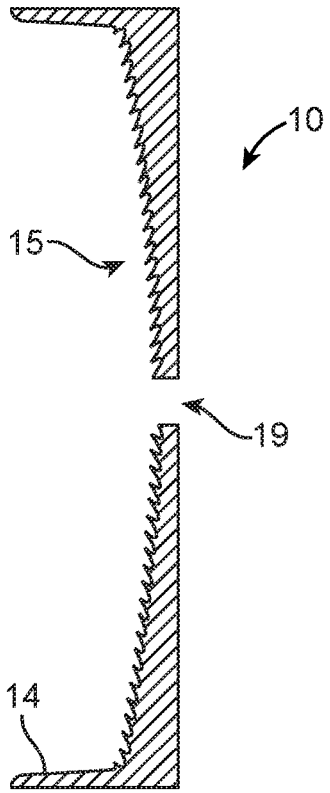
FIG. 2 is a side cross sectional view of FIG. 1.

Turning now to FIGS. 1 and 2, there is disclosed one embodiment of a front view a blown up view and a side cross sectional view of one embodiment of the resulting product to be made by the process disclosed further herein is disclosure. In particular, there is illustrated an ore or material concentrator wheel 10, also known as an ore separator wheel or just wheel, which is well known in the prior art that is incorporated by reference that teaches of this design and use. There is also illustrated a blown up view of the individual valleys 17 located between each ridge or teeth 15. There is a central collection hole 19 for the separated ore to leave the wheel 10 during spinning operations, and a containment wall 14 around the periphery of the entire wheel 14. It is noted that the concave curvature feature of the inside surface of the ore separation wheel 10 may be most any degree of curvature that is benificial to the operation thereof. It is noted that the area near the central hole 19 has many dimensions of the teeth 15 smaller than the outter periphery of the wheel that has larger dimensions for the teeth or riffles, which will be described herein with more specificity. Although, illustrated as a rounded concave surface curve, the inner teeth surface may be a gradually increasing or decreasing set of curvatures, or may be a straight linear angle making up the inner surface containing the teeth 15.

Figure 3:
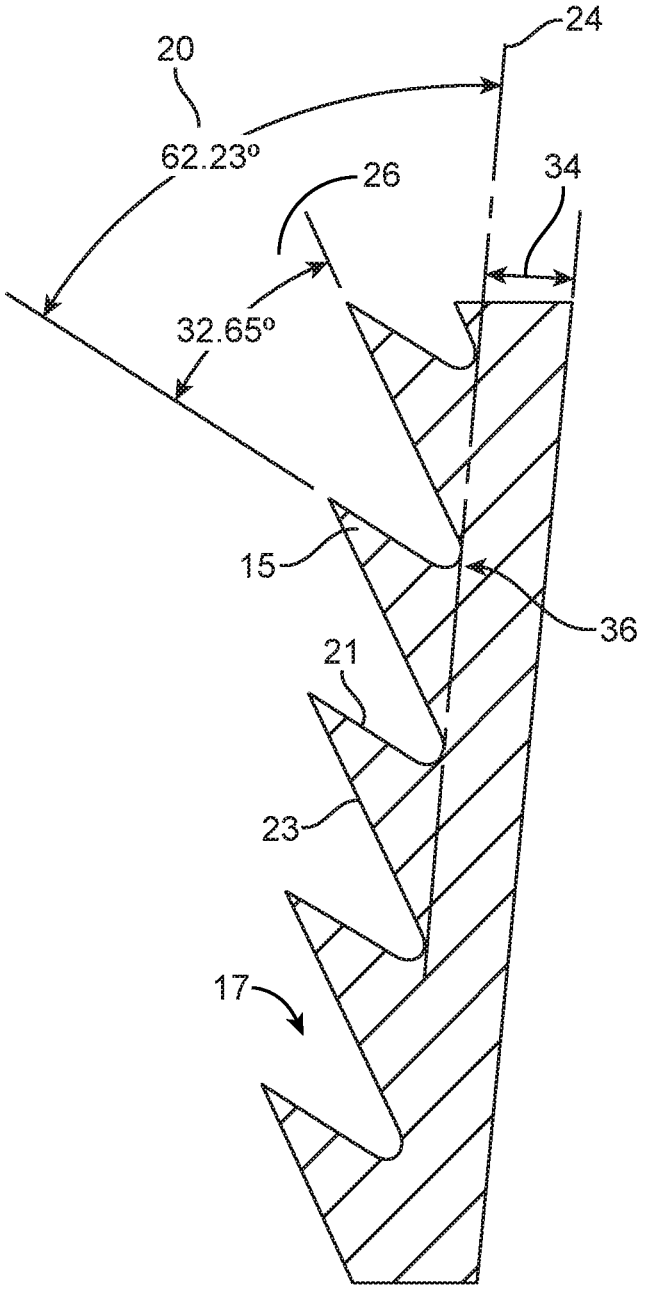
FIG. 3 is a side cross sectional view of a portion of the teeth of FIG. 1.

Referring now to FIG. 3, there is a blown up side sectional view of a series of teeth, riffles, or ridges 15 that spiral inward toward the center hole 19 of the ore concentrator wheel 10. Specifically, in this embodiment, and unlike any known prior art, the respective proportional dimensions are an advantage over the prior art. Wherein, there is an illustrated embodiment of an angle 20 (also referred to as a negative draft or major angle) having illustrated a measure of 62.23 deg. from a backside 21 of each tooth 22 to a plane 24 extending along the bottom portion of each tooth as illustrated. It is specifically noted that this angle is less than 90 deg. which most known prior art meets or exceeds that angle due to prior art teeth 15 manufacturing methods that could not create angles being less than 90 deg. at that position of the separation wheel 10. This illustrated 62.23 deg. angle 20 may be varied in a range of about 89-20 deg., or 80-30 deg., or 75-40 deg., or 70-60 deg., and remain within the scope of the present invention. It is also noted that this angle 20 has the advantage of creating a negative draft during the operation of the wheel 10, which, in one embodiment, has the advantage of assisting in the separation process of the desired ore having a specific gravity of 10.0 or higher. Therefore, any angle less than 90 deg. is considered a negative draft angle. Additionally, in one embodiment, and in light of the other measuresment of the wheel 10, the greater the angel is less than the 90 deg. mark the greater the negative draft that can potentially be created in the valley 17 between the teeth 15. It is also noted, that prior manufacturing methods were not able to create a negative draft angle, and the 3D printing process is able to create this type of angle in the series of teeth 15 as they spiral out from the central region, as illustrated.

Additionally, regarding FIG. 3, there is illustrated a valley angle 26 with an illustrated measurement of 32.65 deg. measured from the backside 21 of each tooth to a front side 23 of each subsequent tooth as illustrated. The valley angle 26 may operatively work within a range of between 20-50 deg., or a range of 25-45 deg. or a range of 30-40 deg. or a range of 30-35 deg. In another embodiment, the valley angle may change from about +/−20 degrees from a inner section to an outer section of the wheel 10.

Figure 4:
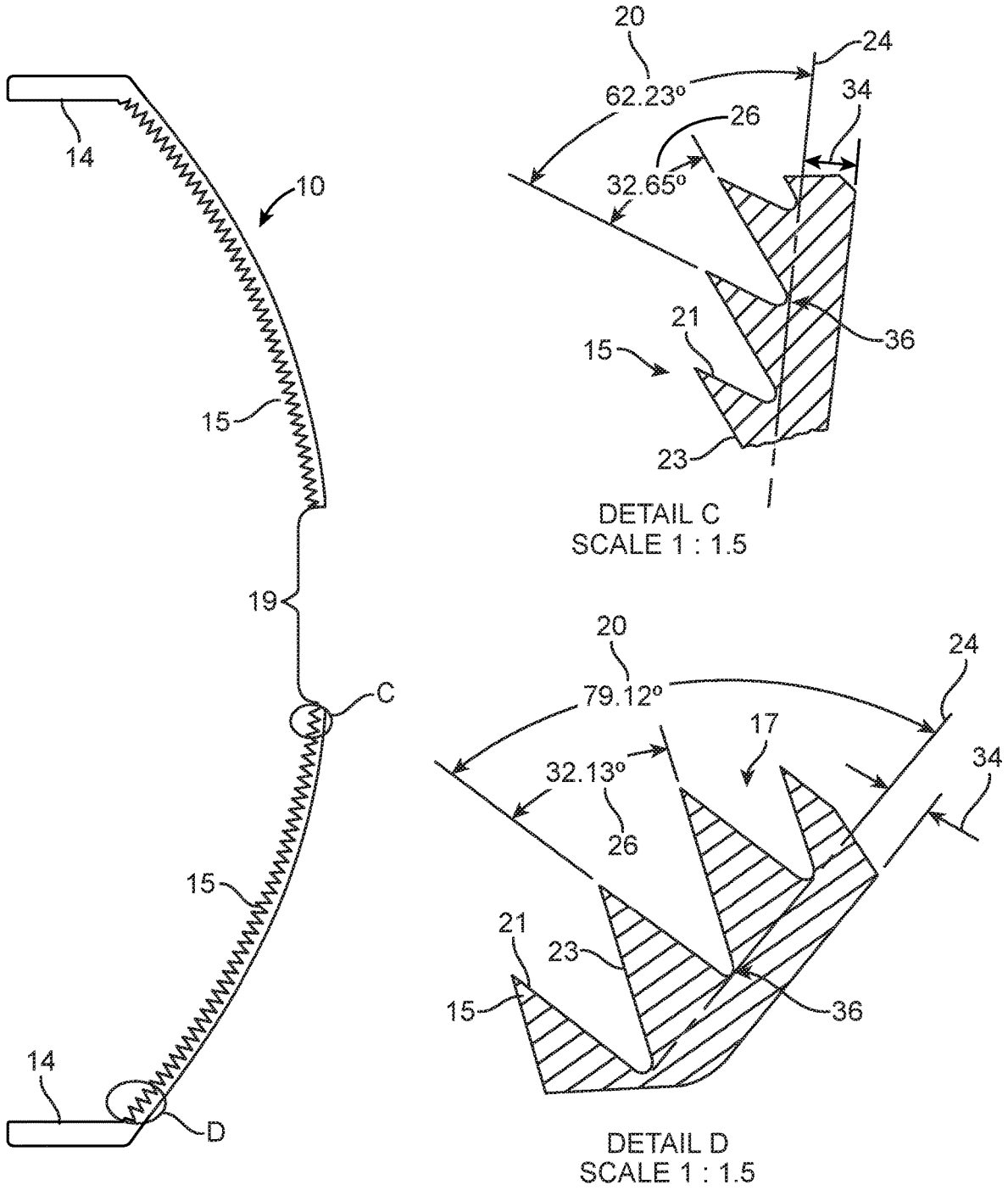
FIG. 4 is a side cross sectional view of a whole wheel of FIG. 1 and two exploded views thereof.
Figure 5:
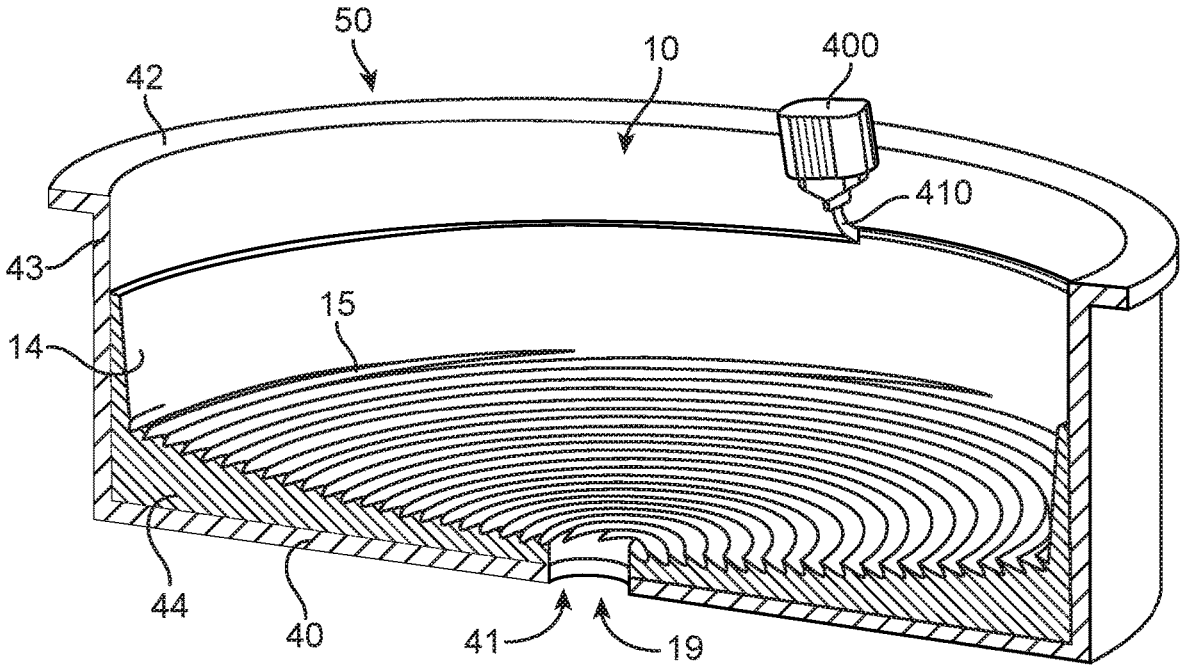
FIG. 5 is an isometric sectional view of FIG. 1 as mounted in a support structure.
Figure 6:
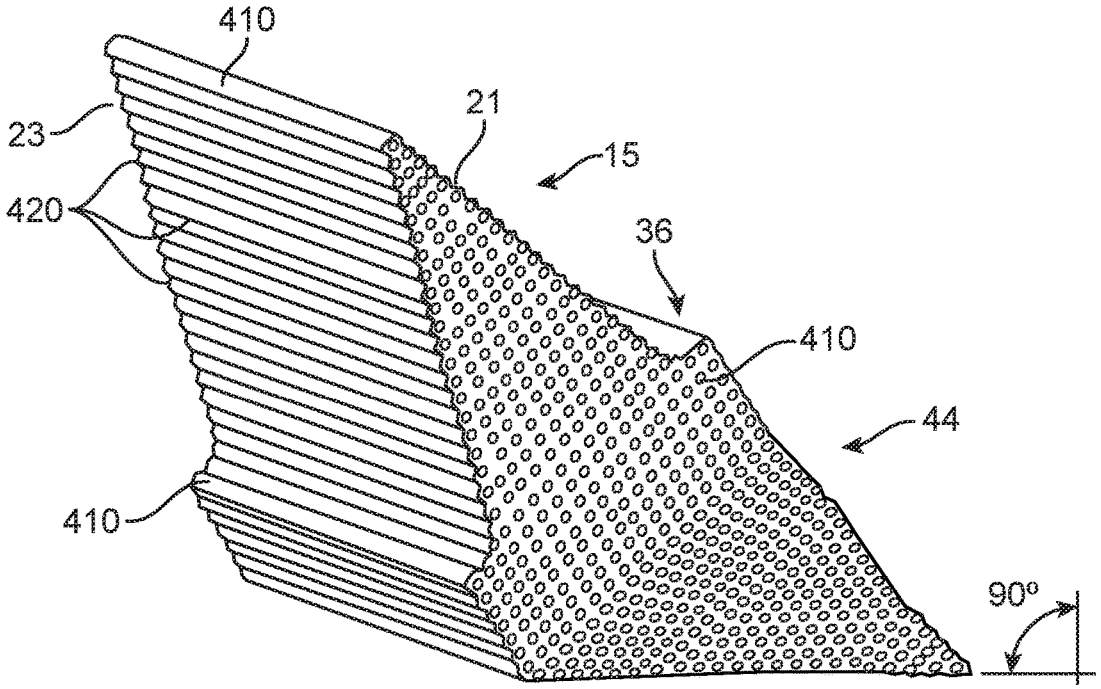
FIG. 6 is an isometric sectional view of one portions of the teeth of FIG. 1.

In another illustrated measurement there is a valley base 36 having an illustrated relative rounded design to smoothly connect the backside 21 and front side 23 of each successive tooth, and to hold ore concentrate therein. This rounded feature 36 is also designed to promote the migrating material to not get stuck on the climb up to the center hole or opening 19. Additionally, the series of radially expanding rows of teeth 15 from the central opening 19 are generally about equal distance from each other and are integrally attached to a base section 34 or 44. In one embodiment the base section 34 has constant thickness under the entire wheel 10 as illustrated in FIG. 3. In another embodiment, the base section 44 will vary in thickness as illustrated in FIGS. 2, 4 and 6. The thickness will depend upon the support structure 50 thickness, as illustrated in FIG. 5, where the support structure base 40 could have been angled in the bottom to enable the wheel base 34 to be and even thickness throughout.

It is noted that in one embodiment, the size of the teeth may be smaller at an inner portion of the wheel 10 near the central opening 19. Additionally, in that same region the overall thickness size may be less, the overall height may be smaller, as well as other dimensions denoting size.

Referring now to FIG. 4, there is another side sectional view of the wheel 10 with blown up portions from an outer section D (also referred to as an outer section of the wheel 10) and an inner section C (also referred to as an inner section of the wheel 10). Specifically, in this embodiment, there is illustrated by the relatively different sizes of sections C and D, that generally the outer section D has larger proportions of measurements than the inner sections C. Wherein, in one embodiment, there is a gradually increasing size over the distance between D and C. In another embodiment, there is step-wise progression of decrease in size from the outer D to the inner C sections. For example, although the outer sections D has an illustrated angle of 79.12 deg. which is smaller than section C, it is contemplated that it may also be larger than section C.

It is additionally noted, in one embodiment, unlike the other dimensions discussed herein, the valley angle 26 in section D has a measurement of about 32.13 degrees and section C has a larger measurement of about 32.65 deg. Wherein, the valley angle 26 may vary between about 10 to 55 degrees in operation.

Continuing on to FIG. 5, there is illustrated a cross sectional view of the wheel 10 as mounted or manufactured with or into support bowl 50. Specifically, there is illustrated the support structure 50, also referred to as the support bowl 50. The support bowl 50 includes a circular base portion 40, circumferential side walls 43, attached to the base portion 40, and a circumferential lip 42, attached to an upper portion of the side wall 43, all as illustrated. In this embodiment, the wheel 10 has a base 44 that is gradually increased in thickness as it approaches the sidewall 43 since the support base 40 is flat and has an even thickness. Uniquely, there is illustrated, in one embodiment, a 3D printer 400 may create and lay down an additive layer 410 forming the wheel 10 inside of the support bowl 50. In another embodiment envisioned by the present applicant, the wheel 10 may be formed by a 3D printing method before being placed into the illustrated support bowl 50.

In one embodiment of the invention, the support bowl 50 is formed using any known manufacturing method, but more specifically, using any known computerized milling machine, a CNC machine, any molding method, fiberglass method, and using any usable material sufficient to provide acceptable support for the wheel 10 to maintain its shape during operating conditions of ore separation, including fiberglass, metal, aluminum, plastic, etc. and combinations thereof.

It is noted, in one embodiment, that the sidewall 14 of the wheel 10 does not extend all the way up the sidewall 43 of the support bowl 50 as illustrated. It is also noted that the base 40 has a base central hole 41 that matches the central hole 19 of the separation wheel 10 as illustrated. In another embodiment, the side wall 14 of the wheel 10 will extend all the way to the top of the support structure wall 43. Also, in a further embodiment, the wheel 10 would extend over the lip 42 of the support structure 50.

Referring now to FIG. 6, there is a cross sectional expanded view of one tooth 15 of the wheel 10. In particular, there is shown individual layers 410 that are methodically stacked up or laid down to form the entire wheel 10. As a result, in one embodiment, there is also formed at least partially along the surface of the wheel, micro grooves 420 that at least partially run along at least a portion of the teeth 15 surfaces. These micro groves, in one embodiment, have proven to be beneficial to the ore separation process during operational periods. The micro grooves will be formed between each layer extruded from the 3D print head at the outer surface of the teeth. These plurality of micro grooves 420 are formed from the 3D printing process leaving a small gap located between subsequent extruded layers at the outer surface of the plurality of teeth as illustrated. In another embodiment, the micro grooves 420 range in size from 4.5 mm to 0.001 mm. In one embodiment, these micro grooves 420 aid in creating an air pocket around the material and further aid in moving the material during the operation thereof.

As illustrated, in one embodiment, the 3D printer 400 will lay down individual layers. These layers, in one embodiment, are shaped in an extruded fashion from a print head, forming a rounded rod or layer 410 as it is laid down or extruded from the printer head. However, in other embodiments, any shape of layer may be used to extrude and be laid down by the 3D printer to form the desired form of the teeth 15 and wheel 10. It is even contemplated to use different shapes, types, and sizes of material being laid down during the 3D printing process. For example, bulkier and larger size material layers for the general base 34 and 44 areas of the wheel 10 not needing any particular intricate shape would be perfectly workable. Whereas, using smaller size material layers in places where the teeth 15 are positioned would be advisable. It is noted that the bulk and size may be simply done by adjusting the diameter of a circular extruded bead from the 3D printing head. This may also include simply increasing the size of the opening of the print head, or increasing the number of print heads used for deposition of a layer. Other print head shapes may be oval, square, rectangular, L-shaped, star, octagonal, strips, thin sheets, triangular, etc.

In an illustrated embodiment, the 3D printing process will lay down extruded beads in a pattern following a desired preset path to create the desired path of the teeth or ridges 15. In the current illustration, the 3D printing will follow a radiating concentrically outward path from the central hole 19 as illustrated all the way out to the outer end abutting to the wall 14. In this fashion, the teeth 15 front and back sides 21 and 23 will have the micro grooves 420 extending a substantial length of the ridge 15 from the central hole 19 to the vertical wall 14.

In another embodiment, the base layers 34, and 44 are laid down in any fashion, direction, diameter, and size to provide the needed support for the more complex layers forming the radiating concentric parallel track teeth 15.

It is noted that it is impossible to have complete uniformity of the parallel grooves 420 for every one of the teeth 15 along their substantial length, due to various manufacturing and design efficiencies. Therefore, in one embodiment, it is desired to have at least a good percentage of the teeth 15 to have such micro grooves 420 running substantially the entire length of the teeth 15. A good percentage can range from 10% to 90%. In another embodiment, all of the teeth 15 will reach the central hole 19, and the valley dimensions will be larger at the outer region D and smaller at the inner region C. Further, the micro-grooves may not all be parallel and may form angles of some sort therebetween. The fact that there are illustrated micro grooves 420 in a somewhat parallell fashion, it is contemplated in this invention to supply micro grooves 420 of any angle to the base 34, 44 on the teeth 15 surfaces.

It is noted that by using multiple print heads, it is desirable to print multiple teeth at the same time, thus increasing the print time efficiency.

Therefore, based on the ability to use 3D printing, it is now possible to print at least a single tooth 15 in a continuous length, having an inner end C having smaller dimensions (like of teeth, negative draft angles 20, and valley size 26) and gradually increasing these dimensions as it reaches the outer end D, and varying the angle of the tooth 15 along that same path during the manufactuing using 3D printing process. Thus reseulting in the ability to dynamically changing critical dimension on a plurality of teeth 15 design from an inner to an outer end thereof It is noted in one embodiment, these micro groove patterns or adjacent micro lines on the surface of the projected spiral portions or teeth create a molecular layer of air along with a wetting agent such as APSA-80 and water, sprayed into the circular ore separation wheel, during rotation thereof to assist the gradual movement and seperation of the heavy materials from the periphery, through the valleys of the projected spiral portions, towards the central hole. Whereby, in one embodiment these microgrooves create air, which creates the ability of encapsulation of the material, by the wetting agent mix, making the material heavier do to the attachment encapsulation, of which allows for better transport and separation of heavies and lights.

It is noted that the illustrated embodiment shows the base layers 34 and 44, whereas most any type of shape for the base layer is conceived herein. The base is merely there to create the desired teeth or riffle curvature. Wherein the overall curvature may be one continuous angle, or be multiple angles that change the overall slop to be greater or lesser as it transcends from the periphery to the inner portions D and C of the concave shape of the wheel.

It is noted that the negative draft angle, or major angle, or any other angle described for the teeth are illustrated as having a flat surface, or parallel surface, or straight surface. Whereas, it is contemplated to have a concave or convex surface on any of the faces or surfaces (i.e. backside 21 and front side 23 of each tooth) of the teeth, or ripples. Thus, it is known that the angle at any one point along the curved face will be different as measured to the base 34, and 44. But, prior methods were either unable to do this or it was too expensive to do such. Whereas, in some embodiments, there is an advantage in having a concave or convex surface in some of the faces, in that they will aid in the capture of the material of desire. Additionally, it is contemplated to form the overall major angle to be greater than 90 deg. but to use a concave face, which in affect, will have at least a portion of the face to be less than 90 deg., and thus benifiting from the 3D printing ability to print an overhand or concave reagion, and thus still having a negative draft affect. So, in one embodiment, only a portion of the front side or back side will be less than 90 deg. In other words, not all of the faces on the teeth are straight, nor all of the surface pieces or parts are completely less than 90 deg., however, at least a portion of the faces of the teeth forming the draft angle will be less than 90 deg.

It should be noted that the steps described in the method of use can be carried out in many different orders according to user preference. The use of "step of" should not be interpreted as "step for", in the claims herein and is not intended to invoke the provisions of 35 U.S.C. § 112, ¶ 6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention.

Although the invention has been explained in relation to its illustrated embodiment, it is to be understood that many other possible modifications and variations can be made without departing from the spirit and scope of the invention.

I claim as follows:

1. A method of making a circular ore separation wheel, comprising:

a) forming a base section of the circular ore separation wheel using 3D printing;

b) forming a central hole in the base section being centrally located in the circular ore separation wheel;

c) forming a plurality of teeth, using 3D printing, upon the base section, having a inner end proximate to the central hole and extending therefrom in a circularly radiating direction and having an outer end opposite the inner end, wherein the forming a plurality of teeth includes forming a plurality of micro grooves partially along surfaces of the teeth in a direction partially running from the inner to outer ends thereof; and d) forming a circumferential wall around the ore separation wheel that is proximate to the outer end of the plurality of teeth, and is proximate to the base section.

2. The method of claim 1, further comprises forming a support bowl, with a bowl central hole and a side support wall and then forming the base, central hole, plurality of teeth, and circumferential wall within the support bowl.

3. The method of claim 2, wherein the circumferential wall is shorter than the side support wall of the support bowl.

4. The method of claim 2, wherein the support bowl is formed of fiberglass.

5. The method of claim 1, wherein at least one of the plurality of teeth have the inner end of the plurality of teeth have at least a portion thereof a major angle having a measure of about 89-10 deg. from a backside of each tooth to a plane extending along a bottom portion of each tooth, wherein the same plurality of teeth will have an outer end of the plurality of teeth have at least a portion thereof with the major angle having a measure of about 10-89 deg. less than the inner end.

6. The method of claim 5, wherein the inner end of the plurality of teeth have a major angle having a measure of about 62 deg. from a backside of each tooth to a plane extending along a bottom portion of each tooth, wherein the same plurality of teeth will have an outer end of the plurality of teeth have the major angle having a measure of about 79 deg.

7. The method of claim 5, further comprising a valley angle with a measurement of 20-50 deg. measured from the backside of each tooth to a front side of each subsequent tooth.

8. The method of claim 7, further comprising a valley angle with a preferred specific measurement of about 32 deg. measured from the backside of each tooth to a front side of each subsequent tooth.

9. The method of claim 7, wherein the inner end of the plurality of teeth have a valley angle having a measure of about 32.65 deg., wherein the same plurality of teeth will have an outer end of the plurality of teeth have the valley angle having a measure of about +/−20 deg. added to the valley angle.

10. The method of claim 1, wherein the base section is laid down in a pattern that is different from the circularly radiating direction of the plurality of teeth.

11. The method of claim 9, wherein the inner end of at least a portion of one of the plurality of teeth with the major angle having a measure of about 10-89 deg. from a backside of each tooth to a plane extending along a bottom portion of each tooth, wherein the outer end of the plurality of teeth will have the major angle having a measure of about 10-89 deg. larger then the inner end thereof.

12. The method of claim 1, wherein forming the plurality of teeth further includes forming at least a portion of a major angle being less than 90 deg.

13. A method of making a circular ore separation wheel, comprising:

a) forming a base section of the circular ore separation wheel using 3D printing;

b) forming a central hole in the base section being centrally located in the circular ore separation wheel;

c) forming a plurality of teeth, using 3D printing, upon the base section, having a inner end proximate to the central hole and extending therefrom in a circularly radiating direction and having an outer end opposite the inner end, d) forming a plurality of micro grooves along outer surfaces of the plurality of teeth extending in a direction from the inner end to the outer end of the plurality of teeth, wherein the plurality of micro grooves are formed by the 3D printing process leaving a small gap located between subsequent extruded layers at the outer surface of the plurality of teeth; and e) forming a circumferential wall around the ore separation wheel that is proximate to the outer end of the plurality of teeth, and is proximate to the base section.

14. The method of claim 13, wherein the base section is laid down in a pattern that is different from the circularly radiating direction of the plurality of teeth.

15. The method of claim 14, where in the forming a plurality of teeth includes forming a plurality of micro grooves partially along surfaces of the plurality of teeth in a direction running from the inner to outer ends thereof.

16. The method of claim 15, wherein the plurality of micro grooves are formed by the 3D printing process leaving about a 4.5 to 0.001 mm gap located between subsequent extruded layers at the outer surface of the plurality of teeth.

17. The method of claim 16, wherein forming the plurality of teeth further includes forming at least a portion of the major angle being less than 90 deg.

18. A method of making a circular ore separation wheel, comprising:

a) forming a base section of the circular ore separation wheel using 3D printing;

b) forming a central hole in the base section being centrally located in the circular ore separation wheel; and c) forming a plurality of teeth, using 3D printing, upon the base section, having a inner end proximate to the central hole and extending therefrom in a circularly radiating direction and having an outer end opposite the inner end, wherein the forming a plurality of teeth includes forming a plurality of micro grooves partially along surfaces of the teeth in a direction partially running from the inner to outer ends thereof, wherein the plurality of micro grooves are formed by the 3D printing process and creating at least a range of from 0.001 mm and up to a 4.5 mm gap located between subsequent extruded layers at the outer surface of at least a portion of the plurality of teeth.

* * * * *